United States Patent [19]

Bacon, Jr.

[11] Patent Number: 4,898,304

[45] Date of Patent: Feb. 6, 1990

[54] VISCOUS LIQUID DISPENSER

[76] Inventor: Benjamin E. Bacon, Jr., 487 Ockley Dr., Shreveport, La. 71105

[21] Appl. No.: 134,858

[22] Filed: Dec. 17, 1987

[51] Int. Cl.[4] ..... B67B 7/24

[52] U.S. Cl. ..... 222/82; 222/103; 222/105; 222/183; 222/386; 100/293

[58] Field of Search ..... 222/386, 325, 323, 319, 222/183, 105, 103, 214, 106, 80, 89, 82, 81; 100/280, 293; 74/544, 522, 519

[56] References Cited

U.S. PATENT DOCUMENTS

| | | | |
|---|---|---|---|
| 1,557,547 | 10/1925 | Anderson | 100/293 |
| 2,423,209 | 7/1947 | Storey | 100/293 |
| 3,009,414 | 11/1961 | Griemert | 100/293 |
| 3,325,058 | 6/1967 | West, Jr. | 222/183 |
| 3,565,292 | 2/1971 | Jinotti | 222/103 |
| 4,214,675 | 7/1980 | Schmit | 222/183 |
| 4,258,865 | 3/1981 | Vahl et al. | 222/214 |
| 4,440,316 | 4/1984 | Christine | 222/183 |
| 4,515,294 | 5/1985 | Udall | 222/214 |
| 4,739,903 | 4/1988 | Bedwell et al. | 222/105 |

*Primary Examiner*—Joseph J. Rolla
*Assistant Examiner*—Kenneth Noland
*Attorney, Agent, or Firm*—John M. Harrison

[57] ABSTRACT

A viscous liquid dispenser which is used in a preferred embodiment for dispensing a viscous liquid such as drywall joint compound or "mud", wall plaster compositions and floor leveling compounds used in the construction industry. In a preferred design, the dispenser is characterized by a box-like container fitted with a lever-operated plunger plate, which is sized to slidably extend into the container and force the viscous liquid compound through a nozzle located in one of the container walls by hand operation of the lever. In another preferred embodiment of the invention, the nozzle is fitted with a removable cutter blade which is exposed to the interior of the container for cutting an encapsulating plastic bag which contains the viscous liquid after the plastic bag and liquid are placed in the dispenser container and pressure is applied to the plastic bag by operation of the plunger plate and lever. In yet another preferred embodiment, optimum pressure is applied by means of a lever having one end hinged to the container dispenser and adjustably fitted with a slotted connector bar which pivotally connects the lever to the plunger plate.

17 Claims, 1 Drawing Sheet

VISCOUS LIQUID DISPENSER

BACKGROUND OF THE INVENTION

1. Field of the Invention

This invention relates to the dispensing of viscous liquids such as liquid construction compounds, including joint compound of or "mud", plaster compositions and floor leveling compounds, in non-exclusive particular. More particularly, the invention relates to a dispenser for dispensing controlled quantities of a viscous liquid construction compound by operation of a hand-operated plunger assembly, wherein the construction compound is placed in the dispenser and is dispensed through a nipple or opening provided in the dispenser. In a preferred embodiment, the dispenser is characterized by a box-like container which is fitted with a nipple having a nozzle and cutter blade therein, wherein pressure is applied to a plastic sack or bag containing the viscous liquid construction compound and the cutter blade ruptures the plastic bag. A flow of viscous liquid is facilitated through the nozzle and nipple into a collecting receptacle responsive to application of pressure on the plastic sack or bag and the encapsulated compound by the plunger assembly. In another preferred embodiment of the invention, the plunger assembly is characterized by an offset lever having one end hinged to the compound dispenser container and a cooperating plunger plate slidably fitted in the container itself and pivotally connected to the lever by means of a connector bar, in order to facilitate application of force to the free end or handle of the lever and forcing the plunger plate into the dispenser container for application of pressure on the viscous liquid construction compound.

One of the problems realized in the application of joint compound or "mud", as well as plaster compositions and floor leveling compounds to walls and floors, respectively, in the construction industry is that of providing a continuing source of joint compound, plaster composition and/or floor leveling compound as work progresses. For example, joint compound or "mud" is commonly pre-mixed to a desired viscous consistency and packaged in plastic bags located inside cardboard boxes. When used, the cardboard box and the plastic bag are opened and the "mud" is usually scooped directly from the plastic bag into a tray which is strapped to the user's waist and applied to a wall, as desired. As the "mud" is removed from the plastic bag, a residue accumulates on the upper portions of the plastic bag extending from the liquid level to the bag mouth and when the plastic bag is folded at the end of the work shift, the dried "mud" flakes from the bag into the residual liquid mud and causes lumps which prevent application of a smooth finish when the "mud" is next applied to the wall. In order to alleviate this problem, the "mud" is sometimes transferred from the original plastic bag into a plastic container such as a paint bucket and is periodically dispensed from the container into the portable tray for application on the wall. However, this procedure does not eliminate the problem of mixing dry mud residue with the wet "mud" in the plastic container, since the "mud" inevitably splatters on the sides of the container above the liquid level and also tends to flake into the "mud" supply.

2. Description of the Prior Art

A search revealed a number of prior art patents concerned with various types of pressure applicators.

These patents are summarized below and a copy is enclosed herein:

U.S. Pat. No. 340,025, dated Apr. 18, 1886, to G. R. Wilson, Jr., details a "Lemon Squeezer". The lemon squeezer is characterized by a pair of flat plates hinged at one end, one of which plates is fitted with a depression having an upward-standing cone in the center thereof, wherein one-half of a lemon can be placed face downwardly in the depression against the cone and squeezed by application of pressure to the flat plates. U.S. Pat. No. 400,323, dated Mar. 26, 1889, to H. Geyer, details a "Hydraulic Sausage Stuffing Machine". The hydraulic sausage stuffing machine includes a hydraulic cylinder having a piston reciprocating therein, with inlet pipes communicating with either end of the cylinder. A rotating 2-way valve controls water flow through the inlet pipes responsive to operation of a counter-balanced lever which actuates the 2-way valve, to apply the required hydraulic pressure. "Peel Oil and Juice Extraction by Fluid Pressure" is detailed in U.S. Pat. No. 2,420,680, dated May 20, 1947, To W. A. Pipkin. The device includes means for forming a hole in the rind of a fruit and supporting a portion of the surface of the fruit, a flexible diaphragm adapted to contact substantially all of the balance of the surface of the fruit and apparatus for exerting fluid pressure against the diaphragm, forcing the diaphragm against the fruit to constrict the fruit and force the juice therefrom. U.S. Pat. No. 2,612,100, dated Sept. 30, 1952, to N. L. Bates, et al, details a "Pnematic Juice Extractor". The juice extractor includes a receptacle having an upwardly open circular mouth with an annular shoulder overhanging the receptacle interior adjacent the mouth, a lower ported member in the receptacle for supporting a sack containing a pulp material, from which fluid is to be removed and an inflatable bladder adapted to seat on the sack within the receptacle, the bladder having an upstanding stem for receiving fluid under pressure for the inflation of the bladder. Further included is a circular closure plate for the receptacle, which closure plate is adapted to overlay the bladder and is ported to receive the upstanding bladder stem. U.S. Pat. No. 4,350,089, dated Sept. 21, 1982, to Oskar Braun, details a "Fruit Juice Press". The fruit juice press detailed in this patent includes a closed container rotatable about its longitudinal horizontal axis and covered by a perforated sheet provided in the jacket of the container. The container is fitted with a filling opening and a pressure membrane made of flexible or elastic material matching the shape of the container is fitted inside the container at the edge of the filling opening and is fastened parallel to the plane passing through the axis of rotation. The membrane divides the interior of the container into a pressure medium and a pressure space. A loosening and draining device is provided in the pressure space inside the container opposite the filling opening and opposing the pressure membrane.

It is an object of this invention to provide a viscous liquid dispenser which includes a container having an open top and fitted with a plunger assembly for applying pressure to a viscous liquid located in the container and dispensing controlled quantities of the liquid through an opening or nipple provided in the container wall.

Another object of the invention is to provide a viscous construction liquid dispenser which is characterized by a box-like structure having an open top and a discharge nipple in one wall near the bottom thereof, and further including a plunger assembly having a plunger plate element for insertion in the top of the dispenser and applying pressure to a viscous construction liquid located in the dispenser to dispense selected quantities of the viscous construction liquid through the nipple into a collecting container.

Yet another object of this invention is to provide a viscous liquid construction compound dispenser which includes a box-like container provided with a discharge nipple in one wall near the bottom thereof, with a cutter blade located in the discharge nipple and facing the interior of the container and a plunger assembly having a plunger plate adapted for insertion in the open top of the container, in order to exert pressure on a plastic bag-encapsulated viscous liquid construction compound located in the container, wherein application of pressure on the plunger plate forces the plastic bag against the cutter blade to facilitate a flow of viscous liquid construction compound through the bag and discharge nipple into a collecting vessel.

A still further object of the invention is to provide a viscous liquid dispenser characterized by a box-like container provided with a discharge nipple in one wall near the bottom thereof, a removable cutter blade disposed in the nipple and communicating with the interior of the container and a plunger assembly for dispensing a plastic bag-encapsulated viscous liquid from the container. The plunger assembly is characterized by a plunger plate designed to slidably extend into the open top of the container and a lever hinged to one edge of the container and pivotally connected to the plunger plate, for application of pressure on the viscous liquid and forcing the plastic bag against the cutter blade to dispense a controlled quantity of viscous liquid through the discharge nipple past the cutter blade, into a collecting container.

Still another object of this invention is to provide a viscous liquid construction compound dispenser which is characterized by a box-like container having an open top and a discharge nipple provided in the wall thereof, with three spaced, bevelled cutter blades mounted in a nozzle adapted for insertion inside the discharge nipple, with the cutter blades oriented in recessed communication with the open interior of the container. A lever element of a plunger assembly is pivotally mounted at one end on one wall of the container and a plunger plate element is shaped to conform to the cross-sectional configuration of the container and is inserted in the container. A slotted bar pivotally connects the lever element and the plunger plate element, for exerting pressure on a viscous liquid encapsulated in a plastic bag and located inside the container. When pressure is applied to the plastic bag and the viscous liquid, the plastic bag is forced into the discharge nipple against the cutter blades and a flow of viscous liquid is effected through the opening in the bag and the nozzle and discharge nipple, past the cutter blades and into a collection container. Additional leverage can be achieved in forcing the viscous liquid through the discharge nipple in controlled quantities by adjusting the lever successively in the slots along the length of the slotted bar as the plunger plate recesses further into the container and the liquid level of the viscous liquid is lowered in the container.

SUMMARY OF THE INVENTION

These and other objects of the invention are provided in a new and improved drywall joint compound dispenser which is characterized by an injection-molded, box-like container open at the top and having a discharge nipple in one side near the bottom thereof, with three bevelled cutter bladed disposed in spaced relationship in a nozzle fitted inside the discharge nipple and provided in communication with the hollow interior of the container. A plunger assembly is used in cooperation with the container for forcing a quantity of the plastic bag-encapsulated drywall joint compound through the nozzle and discharge nipple into a collection vessel. In a first preferred embodiemnt, the plunger assembly is characterized by a plunger plate conforming substantially to the cross-section of the container and inserted downwardly into the container against the dry wall joint compound and its containing plastic bag; a lever pivotally attached to the container at one end; and a connector bar connecting the midpoint of the lever to the plunger plate, in order to facilitate application of a downward force on the free end of the lever and the plunger plate to force the plastic bag containing the drywall joint compound against the cutter blade and the drywall joint compound from the discharge nipple in controlled quantities. In another preferred embodiment, the connector bar is angularly slotted and adjustably extends through the lever and the lever is further provided with a pin for selectively and progressively engaging the spaced slots in the connector bar and exerting additional leverage on the lever responsive to lowering the level of the drywall compound in the container.

BRIEF DESCRIPTION OF THE DRAWING

The invention will be better understood by reference to the accompanying drawing wherein.

DESCRIPTION OF THE PREFERRED EMBODIMENTS

Figure 1:
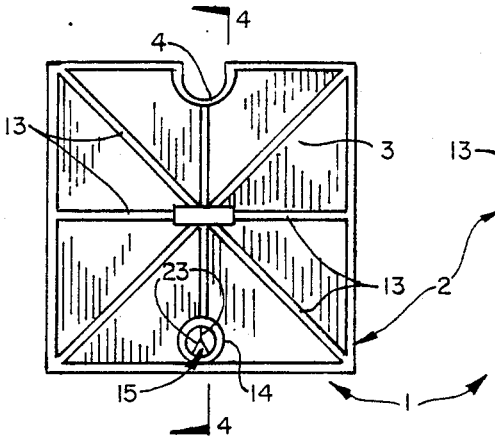
FIG. 1 is a front view of a preferred viscous liquid dispenser of this invention.
Figure 2:
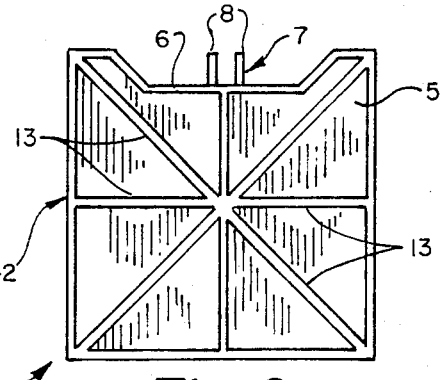
FIG. 2 is a rear view of the viscous liquid dispenser illustrated in FIG. 1.
Figure 4:
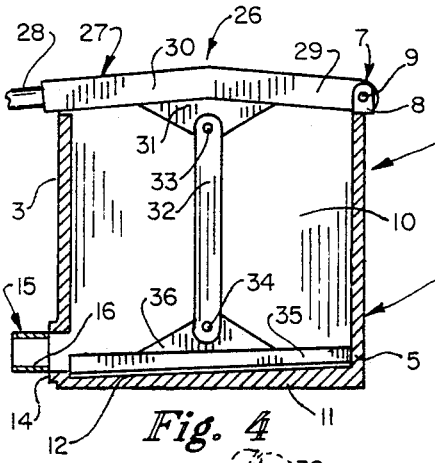
FIG. 4 is a sectional view taken along line 4—4 of the viscous liquid dispenser illustrated in FIG. 1.
Figure 3:
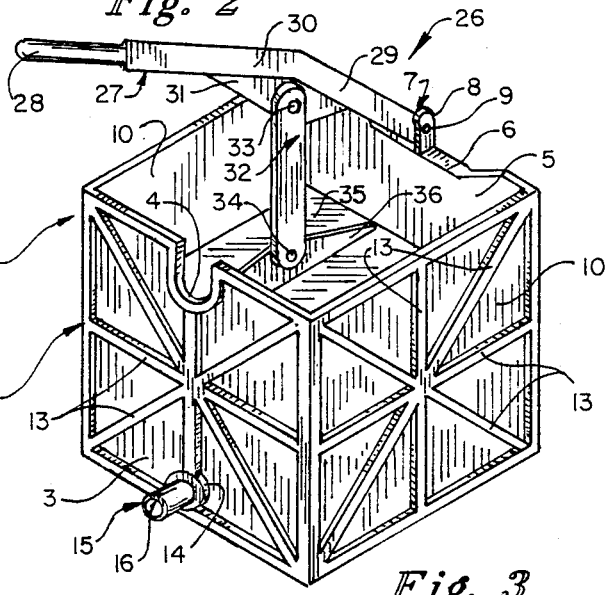
FIG. 3 is a perspective view of the viscous liquid dispenser illustrated in FIGS. 1 and 2.

Referring initially to FIGS. 1–4 of the drawing, the viscous liquid dispenser of this invention is generally illustrated by reference numeral 1. The dispenser 1 includes a generally box-like dispenser container 2, characterized by a front panel 3, having a downwardly-extending front panel slot 4 in the top edge thereof, a rear panel 5, provided with a rear panel recess 6 in the top edge thereof, a pair of side panels 10 and a bottom panel 11. The rear panel recess 6 receives a clevis 7, which is characterized by a pair of spaced clevis brackets 8, upward-standing from the top edge of the rear panel recess 6, as further illustrated in FIG. 2. As illustrated in FIG. 3, a clevis pin 9 extends through the clevis brackets 8, in order to secure one end of the spaced lever shaft plates 29 of an assembly lever 27, to the rear panel 5. Referring to FIG. 4 of the drawing, in a most preferred embodiment of the invention the bottom panel 11 is provided with an internal bottom panel taper 12, which tapers from a point of maximum thickness at the juncture with the rear panel 5 to a point of minimum thickness at the junction with the front panel 3. Furthermore, a discharge nipple 15 is fitted into a nipple seat 14, molded or otherwise provided in the front panel 3, such that the bottom of the nipple opening 16 of the discharge nipple 15 is slightly above the tapered bottom of the bottom panel 11, in order to allow a viscous liquid (not illustrated) to flow from the interior of the dispenser container 2 through the discharge nipple 15, as hereinafter further described. In a most preferred embodiment of the invention, the front panel 3, rear panel 5, side panels 10 and the bottom panel 11 are shaped from a moldable plastic material such as polyethylene and polypropylene, in non-exclusive particular, by injection-molding techniques which are well known to those skilled in the art. Under these circumstances, panel stiffeners 13 are provided in the front panel 3, rear panel 5, side panels 10 and the bottom panel 11, respectively, in order to strengthen the dispenser container 2. Alternatively, the entire dispenser container 2 of the viscous liquid dispenser 1 can be injection-molded from a suitable plastic material, as desired, further according to the knowledge of those skilled in the art. The dispenser container 2 is most preferably characterized by a square container having an open top with a tapered bottom panel 11, in order to facilitate the flow of a contained viscous liquid construction compound entirely from the interior of the dispenser container 2, as hereinafter further described.

Referring now to FIGS. 3 and 4 of the drawing, a plunger assembly 26 is installed on the dispenser container 2, in order to facilitate the flow of a liquid having a high viscosity, such as a viscous liquid construction compound (not illustrated) from the interior of the dispenser container 2 through the discharge nipple 15, under pressure. A primary element of the plunger assembly 26 is the assembly lever 27, which may be constructed of a pair of parallel offset lever shaft plates 29, one end of which lever shaft plates 29 is fitted with a spacer 42 and include a pin opening 37 for pivotal attachment to the parallel clevis brackets 8 by means of the clevis pin 9. The opposite ends of the lever shaft plates 29 of the assembly lever 27 terminate in a hollow handle receptacle 27*a*, provided with internal handle receptacle threads 27*b*. A removable lever handle 28 may be threadibly attached to the handle receptacle 27*a*, as hereinafter further described. A shaft web 31 extends downwardly from the midpoint of one of the lever shaft plates 29 at the shaft bend 30 in the assembly lever 27 and pivotally receives one end of a connector bar 32 by means of a top pin 33. The opposite end of the connector bar 32 is pivotally attached to a plunger plate web 36, extending from the plunger plate 35, by means of a bottom pin 34, as further illustrated in FIGS. 3 and 4. The plunger plate 35 is fashioned slightly smaller than the cross-sectional inside dimensions of the dispenser container 2 and is disposed inside the dispenser container 2 in sliding tolerance adjacent the front panel 3, rear panel 5 and side panels 10, as illustrated. Accordingly, it will be appreciated that the plunger plate 35 can be selectively raised and lowered inside the dispenser container 2 responsive to raising and lowering the assembly lever 27 by grasping the lever handle 28. Furthermore, the plunger plate 35 can be extended downwardly from the top edge of the dispenser container 2 to a position substantially conforming to the bottom panel taper 12 of the bottom pabel 11 of the dispenser container 2 as illustrated in FIG. 4, since the bottom end of the connector bar 32 is pivotally attached to the plunger plate web 36 of the plunger plate 35 and the plunger plate 35 is permitted to offset slightly from the horizontal and thus conform to the bottom panel taper 12.

Referring now to FIGS. 1, 4, 9 and 10 of the drawing, in another most preferred embodiment of the invention a discharge nozzle 17 is adapted for slidable insertion concentrically inside the discharge nipple 15 from the inside of the dispenser container 2 and can be oriented in the discharge nipple 15 with the nozzle flange 20 seated against the inside surface of the nipple seat 14. The nozzle wall 18 of the discharge nozzle 17 is sized to extend inside the discharge nipple 15 and a cutter blade 21 is mounted inside the nozzle opening 19 of the discharge nozzle 17, with the thin, tapered blades 23 converging from fixed attachment to a blade ring 22 to define a blade point 24. In another most preferred embodiment of the invention, three blades 23 are provided in spaced relationship on the blade ring 22 of the cutter blade 21, in order to define the three passages 25 therebetween, to accommodate a flow of viscous liquid construction compound (not illustrated) through the nozzle opening 19 and the discharge nozzle 17, as hereinafter further described. Accordingly, it will be appreciated that the discharge nozzle 17 can be easily removed from concentric orientation in the discharge nipple 15, in order to clean the cutter blade 21 and the nozzle opening 19 after the plunger plate 35 is raised by manipulation of the lever handle 28 and the assembly lever 27.

Figure 6:
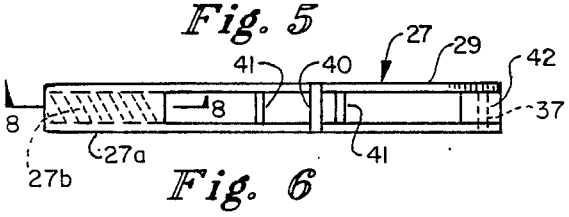
FIG. 6 is a bottom view of a preferred assembly lever for use in the alternative plunger assembly illustrated in FIG. 5.
Figure 9:
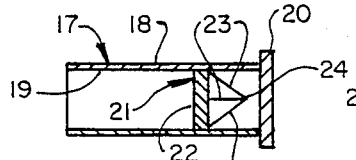
FIG. 9 is a sectional view of a nozzle and a cutter blade used in the viscous liquid dispenser illustrated in FIGS. 1–3.
Figure 10:
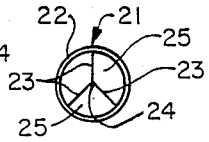
FIG. 10 is a front view of the cutter blade removed from the nozzle illustrated in FIG. 9 and viewed from the interior of the viscous liquid dispenser.
Figure 7:
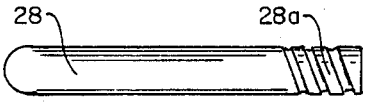
FIG. 7 is a top view of a preferred lever handle for threadible attachment to the assembly lever illustrated in FIGS. 3 and 6.
Figure 8:
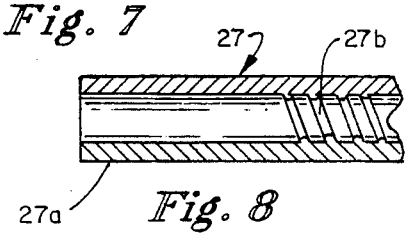
FIG. 8 is a sectional view taken along line 8—8, of the handle end of the assembly lever illustrated in FIG. 6.

Referring now to FIGS. 3, 6, 7 and 8 of the drawing, in another most preferred embodiment of the invention the handle receptacle 27*a*, provided on the free end of the assembly lever 27 and fitted with internal handle receptacle threads 27*b*, as illustrated in FIGS. 6 and 8. Furthermore, as illustrated in FIG. 7, one end of the lever handle 28 is provided with external handle threads 28*a* for registration with the hollow interior of the handle receptacle 27*a* and threadible attachment to the handle receptacle threads 27*b*, as illustrated in FIG. 3. Accordingly, one end of a lever handle 28 of selected length can be threadibly attached to the handle receptacle 27*a* of the assembly lever 27 in the plunger assembly 26, in order to exert a desired degree of pressure on the assembly lever 27 for purposes which are hereinafter further described.

Figure 5:
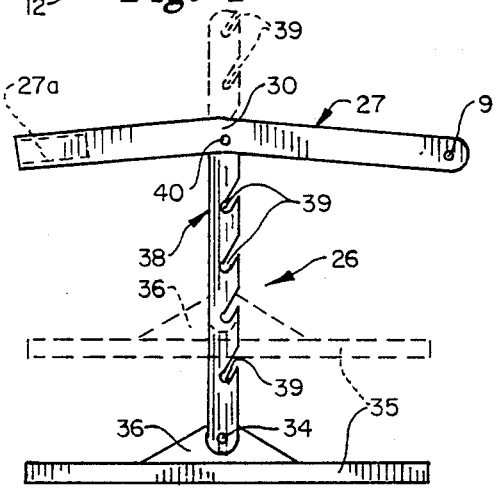
FIG. 5 is a side view of an alternative preferred plunger assembly for use in the viscous liquid dispenser illustrated in FIGS. 1–4.

Referring now to FIG. 5 of the drawing, in yet another preferred embodiment of the invention, the plunger assembly 26 is characterized by a flat, slotted collector bar 38, which replaces the non-slotted connector bar 32 illustrated in FIGS. 3 and 4. Like the non-slotted connector bar 32, the bottom end of the slotted collector bar 38 is pivotally attached to the plunger plate web 36 of the plunger plate 35 by means of a bottom pin 34. The slotted collector bar 38 is fitted with spaced, upwardly-disposed bar slots 39 and a slot pin 40 extends through the assembly lever 27 at the shaft bend 30, for selectively engaging the bar slots 39 as the assembly lever 27 is pivoted on the clevis pin 9. As illustrated in FIG. 6, it will be appreciated that the slotted collector bar 38 extends between the parallel lever shaft plates 29 in the space defined by the guide pins 41, in order to manipulate the intermediately-located slot pin 40 into a selected one of the bar slots 39, respectively. The slotted collector bar 38 is useful under circumstances where a full range of movement of the plunger plate 35 from the top edge to the bottom panel 11 of the compound dispenser 1 is desired, since the assembly lever 27 can be successively adjusted to the next succeeding, higher one of the bar slots 38 as the plunger plate 35 descends into the dispenser container 2, by pressure exerted on the lever handle 28.

In operation, when it is desired to use the viscous liquid dispenser 1 to dispense a quantity of viscous liquid construction compound such as joint compound or "mud", a plaster composition or a floor leveling compound, in non-exclusive particular, the plunger plate 35 is first removed from the dispenser container 2 by grasping the lever handle 28 and raising the assembly lever 27 upwardly. A quantity of the viscous liquid construction compound (not illustrated) located in an encapsulating plastic bag or container (not illustrated) is then lowered into the dispenser container 2 and the plunger plate 35 is again manipulated into position inside the dispenser container 2 on top of the viscous liquid construction compound and the plastic bag enclosure. A downward force is then applied to the lever shaft plates 29 of the assembly lever 27 by grasping the lever handle 28 and this pressure causes the plastic bag enclosure, which encapsulates the viscous liquid construction compound, to expand inside the nipple opening 16 and the discharge opening 17 against the blade point 24 and the blades 23 of the cutter blade 21, to rupture the plastic bag. Additional downward force applied to the assembly lever 27 by operation of the lever handle 28 then forces a quantity of viscous liquid construction compound through the opening cut in the plastic bag and the discharge nozzle 17 and from the discharge nipple 15 into a portable container (not illustrated) for use in dispensing the viscous liquid construction compound on a wall or floor, as the case may be. The quantity of viscous liquid construction compound dispensed from the discharge nipple 15 is therefore determined by the amount of force applied to the lever handle 28 of the assembly lever 27.

It will be appreciated by those skilled in the art that the viscous liquid dispenser of this invention is characterized by convenience and flexibility in operation and is designed to conserve materials as well as save time in the application of various viscous liquid construction compounds. While the dispenser container 2 is most preferably constructed of injection-molded plastic panels in a box-like configuration as noted above, other materials of construction, such as metal and fiberglass, in non-exclusive particular, can also be used. Furthermore, a dispenser container having a cylindrical configuration can be designed to receive a companion round plunger plate 35 and a plunger assembly 26 which accommodates the round dispenser container and plunger plate 35.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A dispenser for dispensing a viscous liquid comprising a container having an open top for receiving a quantity of the viscous liquid; a plunger plate shaped to substantially conform to the interior cross-section of said container and extending into said container in slidable relationship said plunger plate adapted to selectively exert pressure on said viscous liquid; a lever having one end pivotally attached to said container; an elongated connector bar having a plurality of angular slots provided therein in spaced relationship, with one end of said connector bar pivotally attached to said plunger plate and the opposite end of said connector bar slidably projecting through said lever; a slot pin extending through said lever, whereby said slot pin may be selectively and progressively inserted into selected ones of said angular slots responsive to lowering of the level of the viscous liquid in said container; and a discharge opening provided in said container near the bottom thereof, said discharge opening communicating with the interior of said container for discharging the viscous liquid from said container responsive to operation of said lever.

2. The dispenser of claim 1 wherein the viscous liquid is contained in a bag adapted for insertion in said container and further comprising blade means adapted for insertion in said discharge opening and penetrating the bag when pressure is applied to the bag, whereby the viscous liquid is caused to flow from the bag and said container through said blade means in selected quantities responsive to operation of said plunger means.

3. The dispenser of claim 1 further comprising a receiver slot provided in said container beneath said free end of said lever for receiving said free end of said lever when said plunger plate contacts the bottom of said container.

4. The dispenser of claim 1 further comprising a surface bevel provided in the internal bottom surface of said container, whereby said bottom surface slopes toward said discharge opening to better facilitate draining the viscous liquid from said container.

5. The dispenser of claim 1 wherein the viscous liquid is contained in a bag adapted for insertion in said container and further comprising a nipple seated in said discharge opening and blade means adapted for insertion in said nipple and penetrating the bag when pressure is applied to the bag, whereby the viscous liquid is caused to flow from the bag and said container through said nipple and said blade means in selected quantities responsive to operation of said plunger means.

6. The dispenser of claim 5 further comprising a receiver slot provided in said container beneath said free end of said lever for receiving said free end of said lever when said plunger plate contacts the bottom of said container.

7. The dispenser of claim 6 further comprising a surface bevel provided in the internal bottom surface of said container, whereby said bottom surface slopes toward said nipple to better facilitate draining the viscous liquid from said container.

8. The dispenser of claim 5 wherein said blade means further comprises a nozzle adapted for slidable and removable insertion inside said nipple and at least one blade carried by said nozzle for engaging and cutting the bag, and further comprising:

(a) a receiver slot provided in said container beneath said free end of said lever for receiving said free end of said lever when said plunger plate contacts the bottom of said container; and (b) a surface bevel provided in the internal bottom surface of said container, whereby said bottom surface slopes toward said nipple to better facilitate draining the viscous liquid from said container.

9. The dispenser of claim 1 wherein said blade means further comprises a nozzle adapted for slidable and removable insertion inside said nipple and at least one blade carried by said nozzle for engaging and cutting the bag.

10. A viscous liquid dispenser comprising a box-like container having an open top for receiving a quantity of the viscous liquid; a plunger plate extending into said container, said plunger plate shaped to substantially conform to the interior cross-section of said container in slidable relationship and adapted to selectively exert pressure on the viscous liquid; a lever having one end pivotally attached to said container; an elongated connector bar and a plurality of angular slots provided in said connector bar in spaced relationship, with one end of said connector bar pivotally attached to said plunger plate and the opposite end of said connector bar slidably projecting through said lever; a discharge nipple extending from said container near the bottom thereof, said discharge nipple communicating with the interior of said container; and a slot pin extending through said lever, whereby said slot pin may be selectively and progressively inserted into selected ones of said angular slots responsive to lowering of the level of the viscous liquid in said container responsive to application of a downward force on the free end of said lever for discharging the viscous liquid from said container responsive to hand operation of said lever.

11. The viscous liquid dispenser of claim 10 wherein the viscous liquid is contained in a bag adapted for insertion in said container and further comprising a cutter blade adapted for mounting in said discharge nipple and penetrating the bag when pressure is applied to the bag, whereby the viscous liquid is caused to flow from the bag and said container through said cutter blade in selected quantities responsive to operation of said plunger means.

12. The viscous liquid dispenser of claim 10 further comprising a receiver slot provided in said-container beneath said free end of said lever for receiving said free end of said lever when said plunger plate contacts the bottom of said container.

13. The viscous liquid dispenser of claim 12 further comprising a surface bevel provided in the internal bottom surface of said container, whereby said bottom surface slopes toward said discharge nipple to better facilitate draining the viscous liquid from said container.

14. An apparatus for dispensing liquid drywall joint compound in controlled quantities comprising a box-like container having four walls, a bottom and an open top for receiving a quantity of plastic bag-encapsulated liquid drywall compound; a plunger plate shaped to substantially conform to the interior cross-section of said container in slidable relationship; a lever having one end pivotally attached to one of said walls of said container and disposed over said open top; an elongated connector bar and a plurality of angular slots provided in said connector bar in spaced relationship, with one end of said connector bar pivotally attached to said plunger plate and the opposite end of said connector bar slidably projecting through said lever; a slot pin extending through said lever; a discharge nipple projecting from a selected one of said walls near said bottom, said discharge nipple communicating with interior said container; and blade means adapted for insertion in said discharge nipple and penetrating the plastic bag, whereby said slot pin may be selectively and progressively inserted in selective ones of said angular slots responsive to lowering of the level of the viscous liquid in said container, for exertion of additional pressure on said lever to more efficiently force the liquid drywall joint compound from said container through said discharge nipple.

15. The apparatus of claim 14 wherein said blade means further comprises a nozzle adapted for slidable and removable insertion inside said nipple and at least one blade carried by said nozzle for engaging and cutting the bag.

16. The apparatus of claim 15 further comprising a surface bevel provided in said bottom of said container, whereby said bottom slopes toward said discharge nipple to better facilitate draining the viscous liquid from said container.

17. The apparatus of claim 16 further comprising a lever handle threadibly carried by said lever for extending the length of said lever.

* * * * *